US005799979A

United States Patent [19]

Hutton

[11] Patent Number: 5,799,979

[45] Date of Patent: Sep. 1, 1998

[54] PERFORATED COVER

[75] Inventor: Theodore A. Hutton, Versailles, Ky.

[73] Assignee: Publishers Printing Company, Inc., Shepherdsville, Ky.

[21] Appl. No.: 767,531

[22] Filed: Dec. 16, 1996

[51] Int. Cl.[6] ..... B42D 3/00

[52] U.S. Cl. ..... 281/29; 281/15.1; 281/37

[58] Field of Search ..... 281/15.1, 16, 17, 281/18, 19.1, 20, 29, 36, 37, 51; 402/70, 73

[56] References Cited

U.S. PATENT DOCUMENTS

| | | | |
|---|---|---|---|
| 741,693 | 10/1903 | Murray . | |
| 2,108,749 | 2/1938 | Harris . | |
| 2,342,981 | 11/1944 | Stanley . | |
| 3,078,107 | 2/1963 | Loderhose . | |
| 3,310,321 | 3/1967 | Freund . | |
| 3,565,462 | 2/1971 | Gottlieb . | |
| 4,519,630 | 5/1985 | Holmes | 281/37 |
| 4,577,890 | 3/1986 | Boyett | 281/29 |
| 4,614,364 | 9/1986 | Bortner . | |
| 4,703,933 | 11/1987 | Cahill et al. . | |
| 4,705,301 | 11/1987 | Dojel . | |
| 5,470,109 | 11/1995 | Grande | 281/19.1 |

OTHER PUBLICATIONS

Imaging Business, vol. 2, No. 4, Apr. 1996 cover.

*Primary Examiner*—Willmon Fridie, Jr.

*Attorney, Agent, or Firm*—Wheat, Camoriano, Smith & Beres, PLC

[57] ABSTRACT

A magazine cover is made with a perforated front cover which can be torn along the perforation to reveal the inside front cover while retaining the front cover on the magazine. This is accomplished efficiently by forming the front cover, inside front cover and back cover from a single sheet of material that is folded, perforated, and bound to the magazine pages to form the magazine.

12 Claims, 4 Drawing Sheets

PERFORATED COVER

BACKGROUND OF THE INVENTION

Magazines with a split front cover are popular, because they create prime advertising space on the inside front cover which is not available in a normal magazine. However, these magazines are difficult to manufacture and ship.

The split front cover has been made in two pieces, and it is very difficult to get the two sides printed so that their colors match perfectly and so that they line up correctly. It is also difficult to bind these magazines. They have not been able to be bound in a high speed line as with a traditional magazine.

Since the front flaps tend to open up during shipping, the Post Office refuses to ship these magazines, requiring that they be wrapped so that the front cover does not interfere with the Post Office's equipment.

SUMMARY OF THE INVENTION

The foregoing problems have been solved by the present invention, which provides a cover design that is readily manufactured in a high speed line and that provides for the two sides of the front cover to be perfectly matched in color and in alignment.

The present invention also provides a cover design that solves the shipping problems, by keeping the split front flaps together until after the product is shipped.

DESCRIPTION OF THE PREFERRED EMBODIMENTS

Figure 1:
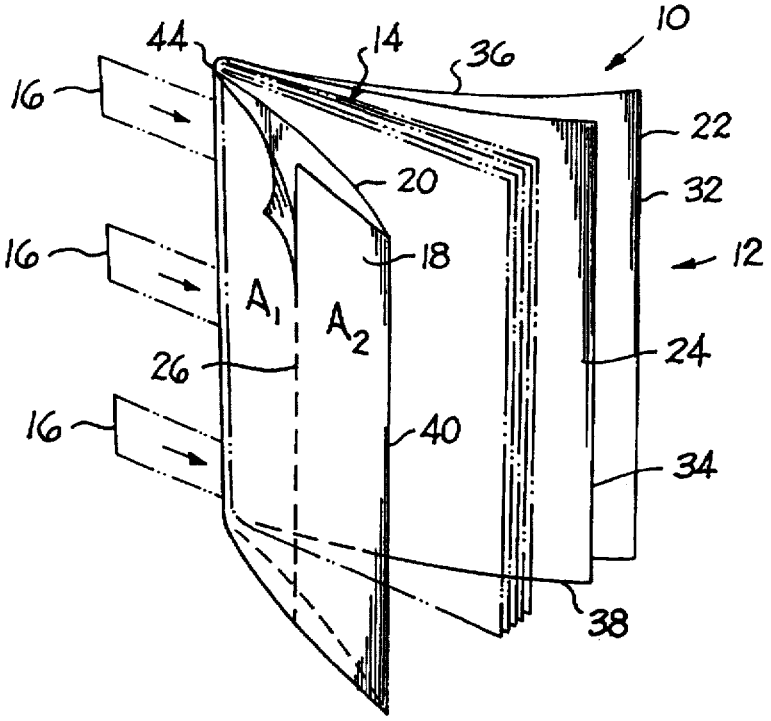
FIG. 1 is a perspective view of a first embodiment of a magazine made in accordance with the present invention.

FIGS. 1–10 show examples of two preferred embodiments made in accordance with the present invention. Looking first at FIG. 1, there is a magazine 10, which has a cover 12 and pages 14 bound together by staples 16. The staples 16 extend through the cover 12 and the pages 14 to bind the magazine together. Many other mechanical binding mechanisms are known which bind by extending through the cover and pages, such as stitching or extending another type of fastener through the cover and pages.

The cover 12 includes a front cover 18, an inside front cover 20, a back cover 22, and an inside back cover 24. The cover 12 is usually made of a heavier stock than the pages

14. The front cover 18 has a row of perforations 26 extending from top to bottom so that, if the front cover is torn along its row of perforations 26, it forms left and right flaps A1, A2, which open to reveal the inside front cover 20.

Figure 2:
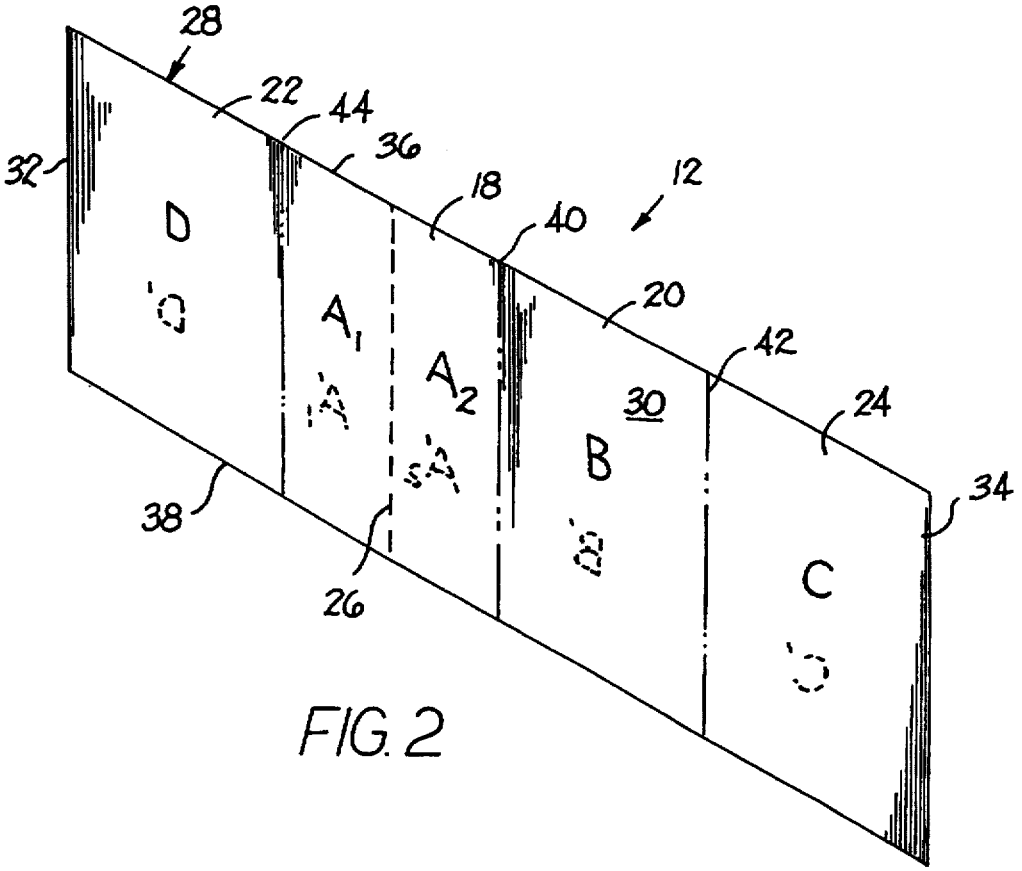
FIG. 2 is a view of the cover of the magazine of FIG. 1 before it is folded.

The cover 12 is formed from a sheet of material 28, as shown in FIG. 2. The sheet 28 has a front surface 30, and a back surface which is opposite the front surface 30. It has left and right ends 32, 34, and top and bottom edges 36, 38, respectively. In a normal manufacturing process, the sheet 28 is a part of a long, continuous roll of material, which is printed on both sides and is then cut into sheets 28 as shown here.

As the sheet 28 is being cut off of the roll, the row of perforations 26 is also formed. These drawings show the row of perforations 26 straight down the center of the front cover 18, but the row of perforations 26 could be offset to one side or could lie at an angle. Preferably, the row of perforations 26 extends all the way from the top edge 36 to the bottom edge 38 of the front cover 18.

FIG. 2 shows the panel D of the continuous sheet 28. The sheet includes continuous, adjacent panels D, A1 and A2, B, and C. When folded, the panel D forms the back cover 22, the panel A1, A2 forms the left and right flaps of the front cover 18, the panel B forms the inside front cover 20, and the panel C forms the inside back cover 24. The front cover panel 18 lies between the back cover D and the inside front cover panel B before the panels are folded. The panels D, A1, A2, B, and C are preferably parallel to each other.

Figure 3:
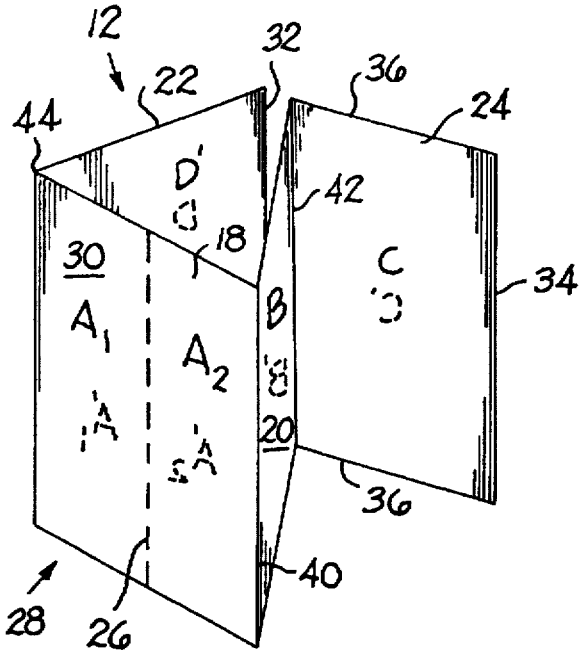
FIG. 3 is a perspective view of the cover of FIG. 2 as it is being folded.
Figure 4:
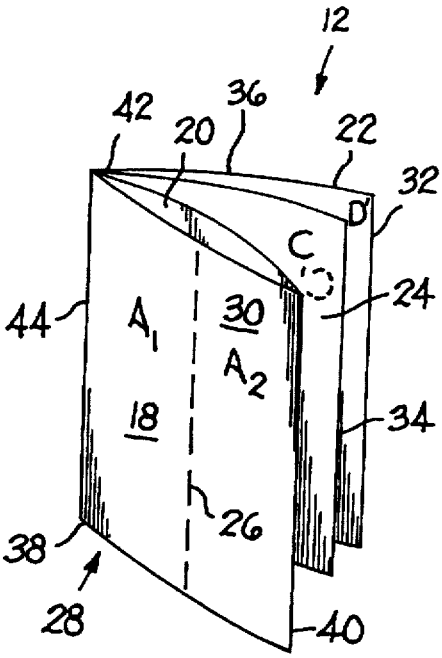
FIG. 4 is a perspective view of the cover of FIG. 3 being folded further.
Figure 5:
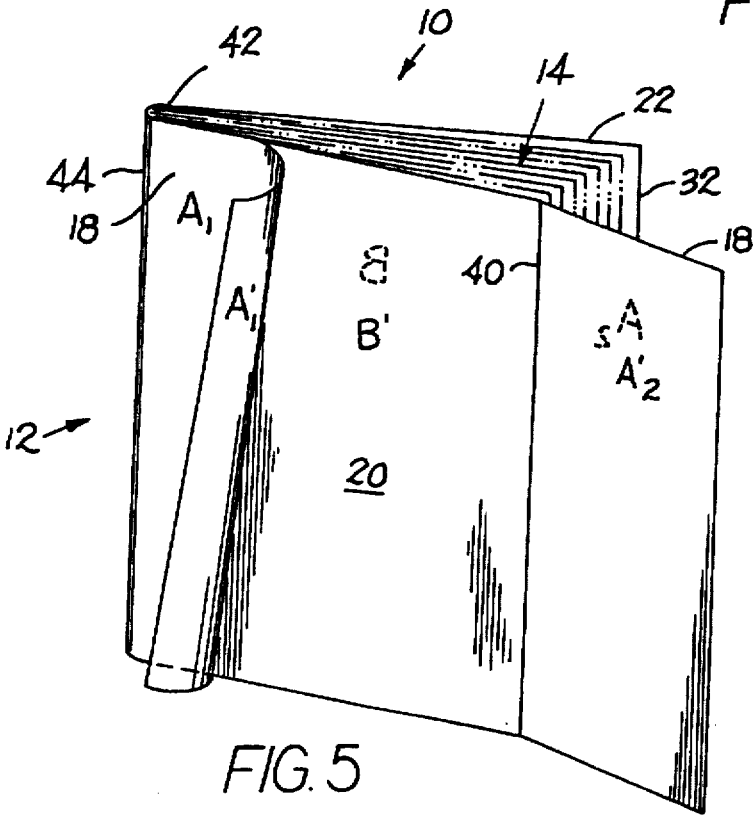
FIG. 5 is a perspective view of the magazine of FIG. 1 after the front flaps have been opened.
Figure 6:
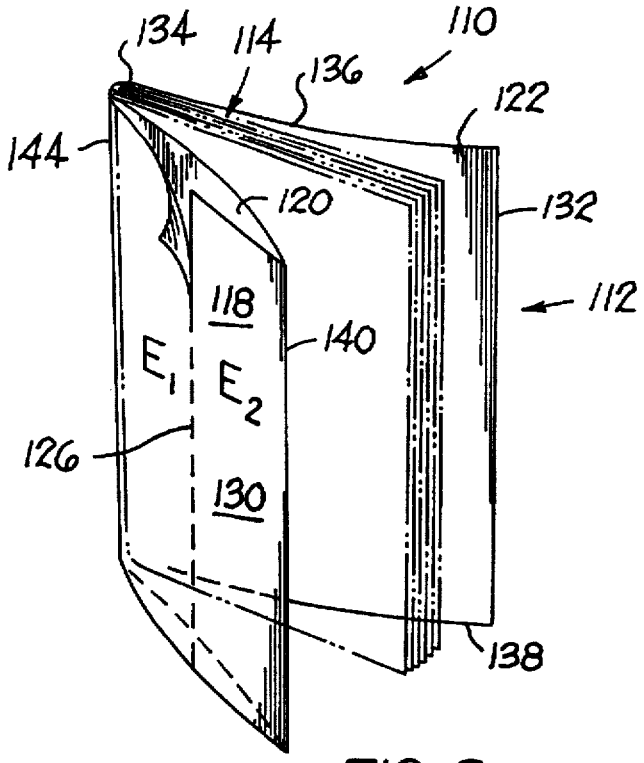
FIG. 6 is a perspective view of a second embodiment of a magazine made in accordance with the present invention.

FIGS. 3 and 4 show how the sheet 28 is folded up to form the cover. The folds that are made are parallel to each other and extend from the top edge 36 to the bottom edge 38. First, the cover 12 is folded in half at the line 40, which is the right edge of the front cover 18 and the left edge of the inside front cover 20. Then it is folded again along the lines 42, 44, with the front cover 18 and inside front cover 20 being at least ¼-inch shorter than the trim size of the magazine 10, so that the fold 40 is not cut off when the magazine is trimmed. Then, the cover 12 is automatically bound to the pages 14 by staples 16 or other mechanical connectors that extend through the folds 42, 44 of the cover 12 and through folds in the pages 14.

A mailing label may be placed on the cover 12, so the magazine 10 can be shipped by the Post Office. Then, when the consumer receives the magazine 10, he or she tears the front cover 18 along the row of perforations 26 to reveal advertising space on the back surfaces A1' and A2' of the flaps A1 and A2 of the front cover 18 and on the back surface B' of the inside front cover 20. The front cover 18, back cover 22, inside front cover 20, and inside back cover 24 remain bound to the magazine 10 after the front cover 18 is torn along the row of perforations 26.

Since the two panel portions A1, A2 of the front cover panel 18 are a single piece during printing and binding, the two portions A1, A2 are printed together, so the colors on the two sides match, and the panels A1, A2 are aligned throughout the printing, folding, collating, and binding processes.

FIGS. 6–10 show a second embodiment of a magazine made in accordance with the present invention. In describing these figures, the numbering corresponds to the numbering for the first embodiment, except that the numbers are preceded by a "1".

The magazine 110 includes a cover 112 and pages 114. Instead of being bound by staples or other mechanical connectors, the magazine 110 is bound by glue. The cover 112 includes a front cover 118, inside front cover 120, and a back cover 122. There is a row of perforations 126 extending from the top edge 136 to the bottom edge 138 of the front cover 118, which can be torn open to reveal the inside front cover 120.

Figure 7:
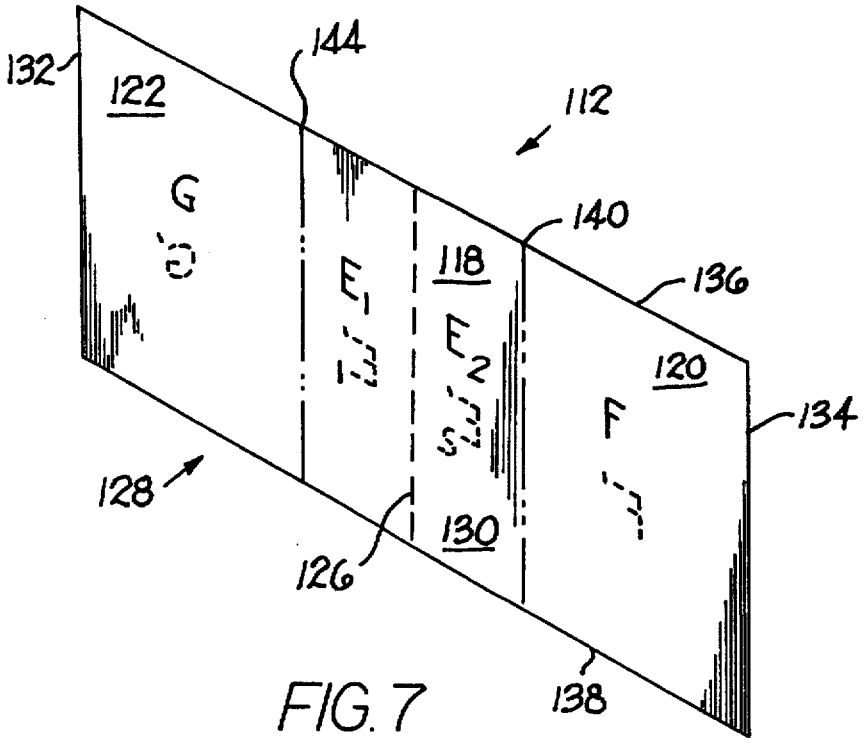
FIG. 7 is a view of the cover of FIG. 6 before it is folded.

FIG. 7 shows a sheet of material 128 which forms the cover 112. This sheet 128 has a front surface 130, a back surface opposite the front surface, a left edge 132, a right edge 134, a top edge 136, and a bottom edge 138. The sheet 128 is folded approximately into thirds along the lines 140, 144, so that the panels E1, E2 form the front cover 118, the panel F forms the inside front cover 120, and the panel G forms the back cover 122. In this embodiment, as in the previous embodiment, the sheet 128 is preferably rectangular, and the folds 140, 144 are preferably made perpendicular to the top and bottom edges 136, 138 and parallel to the left and right edges 132, 134 of the sheet 128.

Figure 8:
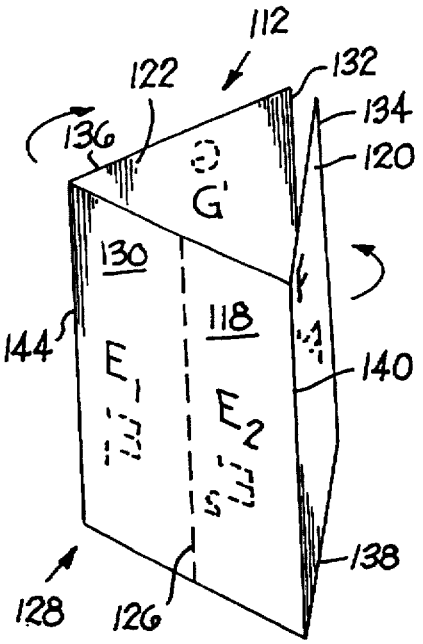
FIG. 8 is a perspective view of the cover of FIG. 7 as it is being folded.
Figure 9:
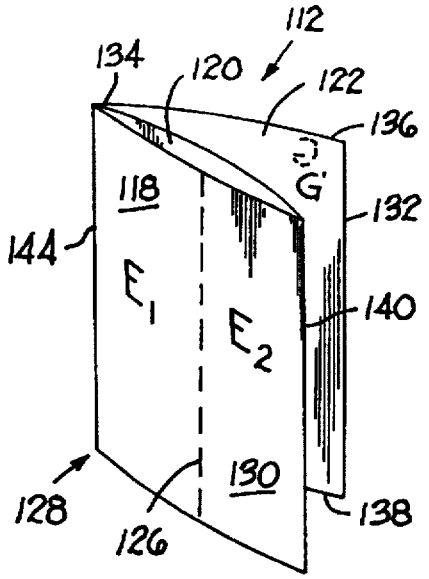
FIG. 9 is a perspective view of the cover of FIG. 8 being folded further.
Figure 10:
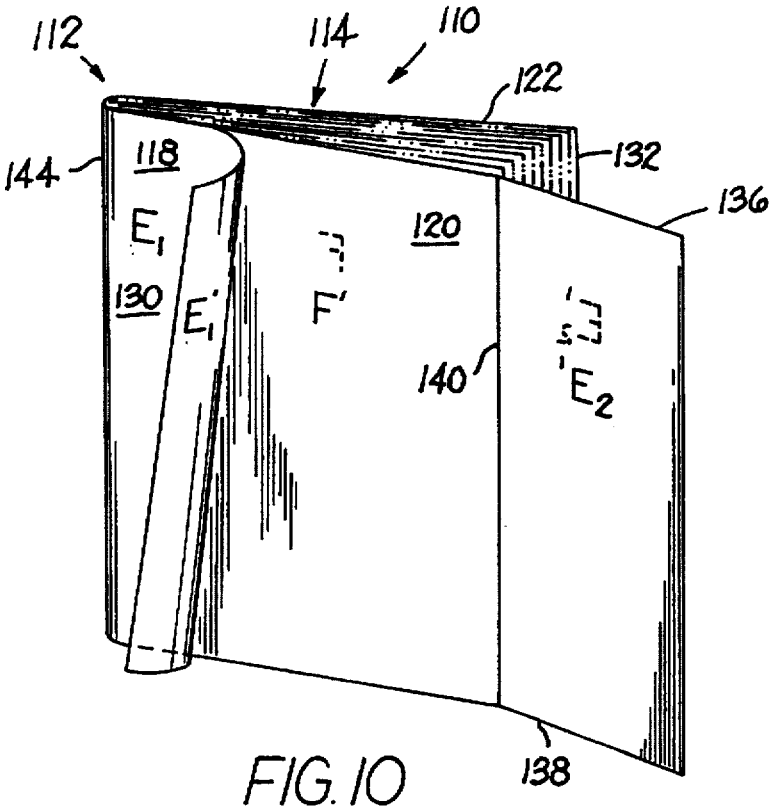
FIG. 10 is a perspective view of the magazine of FIG. 6 with the front flaps opened.

As with the first embodiment, the sheet 128 is originally part of a large roll of material, which is continuously printed on both sides. When the sheet 128 is cut from the roll, the row of perforations 126 is also formed. Then, the sheet 128 is folded as shown in FIGS. 8 and 9 to form the cover 112. In this embodiment, a bead of glue is placed at the fold 144 to ensure that the inside front cover 120 remains bound to the fold 144. Then, the pages 114 are sanded down in a known process to expose the left edges of all the pages 114, glue is applied, and the cover 112 is wrapped around the pages 114, thereby gluing the cover 112 to the pages 114 and binding the magazine 110 together. Again, a label may be automatically put on the magazine, and the magazine may be shipped to the consumer. The consumer then tears open the front cover 118 along the row of perforations 126, separating the two flaps E1 and E2, revealing advertising space on the inside of the flaps E1', E2' and on the inside front cover 120.

The front cover 118, inside front cover 120, and back cover 122 remain bound to the magazine 110 even after the front cover 118 is torn along the row of perforations 126.

It will be obvious to those skilled in the art that modifications may be made to the embodiments described above without departing from the scope of the present invention.

What is claimed is:

1. A cover for a magazine, comprising:

a continuous sheet of material folded to form at least three continuous, adjacent panels, each having a front surface, a back surface, and top, bottom, left side and right side edges, said three panels being connected to each other at their side edges, said panels forming the front cover, inside front cover, and rear cover of the magazine, with the front cover being perforated so that, when it is torn along its perforation, it opens to reveal the inside front cover, and wherein said front cover remains connected to said magazine after the front cover is torn along its perforation.

2. A cover for a magazine as recited in claim 1, wherein the front cover panel lies in between the back cover and the inside front cover before said panels are folded.

3. A cover as recited in claim 2, and further comprising an inside back cover, which is adjacent to the back cover before the panels are folded.

4. A cover as recited in claim 1, wherein said panels are parallel to each other.

5. A cover as recited in claim 2, and further comprising pages of the magazine, which are inside said cover and are bound together with said cover.

6. A cover as recited in claim 5, wherein said magazine is bound by gluing.

7. A cover as recited in claim 3, and further comprising pages of the magazine, which are inside said cover and are bound together with said cover by means of mechanical connectors which extend through the cover and through the pages.

8. A method of making a magazine cover, comprising the steps of:

providing a continuous sheet of material, having an outer surface and an inner surface;

printing on the inner and outer surfaces of the continuous sheet;

folding the sheet to form a front cover, an inside front cover, and a back cover; and perforating the front cover so that, when it is torn along the perforation, it reveals the inside front cover and so that the front cover is retained on the sheet even after being torn along the perforation.

9. A method of making a magazine cover as recited in claim 8, and further folding said sheet to form an inside back cover.

10. A method of making a magazine cover as recited in claim 8, and further binding said cover to pages to form a magazine.

11. A method of making a magazine cover as recited in claim 10, wherein said pages and cover are bound together by gluing.

12. A method of making a magazine cover as recited in claim 9, and further binding said cover to pages by extending mechanical fasteners through the cover and pages.

* * * * *